United States Patent [19]

Persons, Jr.

[11] 4,246,706

[45] Jan. 27, 1981

[54] REINFORCING PAD FOR ATHLETIC SHOES

[76] Inventor: Seth G. Persons, Jr., P.O. Box 3528, Montgomery, Ala. 36109

[21] Appl. No.: 40,543

[22] Filed: May 21, 1979

[51] Int. Cl.[3] ..... A43B 13/22; A43C 13/00

[52] U.S. Cl. ..... 36/73; 36/71.5

[58] Field of Search ..... 36/73, 74, 75, 71, 71.5, 36/69, 35 A, 129, 34 A

[56] References Cited

U.S. PATENT DOCUMENTS

| | | | |
|---|---|---|---|
| Re. 26340 | 2/1968 | Dassler | 36/129 |
| 1,124,062 | 1/1915 | Robinson | 36/71.5 |
| 1,181,807 | 5/1916 | Solomon | 36/73 |
| 2,040,001 | 5/1936 | Jones | 36/71.5 |
| 2,710,463 | 6/1955 | Liska | 36/71.5 |
| 3,593,437 | 7/1971 | Kogert | 36/34 A |
| 3,852,898 | 12/1974 | Rubens | 36/73 |

FOREIGN PATENT DOCUMENTS

| | | | |
|---|---|---|---|
| 1093027 | 11/1967 | United Kingdom | 36/35 A |

*Primary Examiner*—James Kee Chi

*Attorney, Agent, or Firm*—Hugh P. Carter

[57] ABSTRACT

Disclosed is a reinforcing pad adapted to be glued or otherwise secured to the high-wear areas of athletic shoes. Specifically, the pad comprises generally a tear drop or triangular-shaped piece of high denisty or high impact material such as polyurethane having a durometer of from about 70 to about 95 on the Shore A scale. The body is adapted to be secured to the shoe with the hypotenuse of the triangle or one side of the tear drop shape extending generally fore and aft of the sole and with the thicker side of the shape adjacent an edge of the sole.

1 Claim, 6 Drawing Figures

REINFORCING PAD FOR ATHLETIC SHOES

This invention relates to reinforcement means for prolonging the life of the soles of athletic shoes such as shoes used by runners.

With running or jogging becoming a national hobby and pastime, it has been found that the soles of running shoes last an inordinately short length of time. The average person, when jogging, comes down hard on a part of the heel of the sole, usually the outside or, that part of the heel opposite the instep side of the shoe. Upon pressing himself forwardly, the average person raises himself partly on the ball of the feet, resulting in an area of high wear on the ball of the foot forward of the arch but behind the second toe.

Various types of reinforcements for the soles of shoes have been proposed. However, so far as I am aware, none of them have been entirely satisfactory because the materials, shape, size and configuration of the previous reinforcing pads or bodies has not been inobtrusive enough to the wearer of the shoe not to interfere with the normal function, such as running.

In view of the foregoing an object of my invention is to provide a readily attachable reinforcing pad which shall be made of high density or high impact material such as polyurethane, having a hardness range which on the one hand is soft enough not to interfere materially with the normal function of the sole of the shoe, but on the other hand which is hard enough to resist wear. Specifically, I propose the use of polyurethane having a density of from about 70 to about 95 on the Shore A scale. Furthermore, my invention contemplates the provision of a specific shape for the pad. Preferably, the pad is made generally triangular or teardrop in shape although the corners are rounded, and the base and side of the triangular shape are the thicker parts of the pad, and the same tapers toward the hypotenuse, to provide a feather edge along the hypotenuse. The sole side of my improved pad of course is flat and all of the shaping or sculpturing of the same takes place on the wear side.

A reinforcing pad illustrating features of my invention is shown in the accompanying drawings in which.

Figure 3:
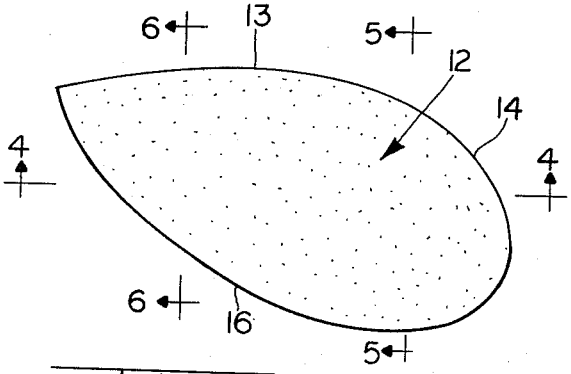
FIG. 3 is a view of one of the pads removed from the shoe.
Figure 4:
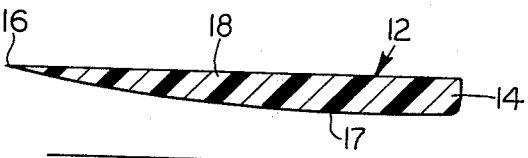
Figure 5:
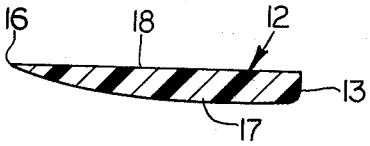
Figure 6:
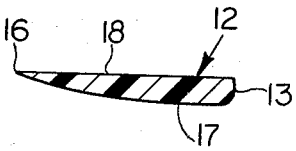

FIGS. 4, 5 and 6 are detail sectional views taken respectively along the lines 4—4, 5—5 and 6—6 of FIG. 3.

Referring now the the drawings for a better understanding of my invention I show at 10 a bottom view of what might be a typical runner's shoe. Thus, the sole 11 of the shoe is generally made of some flexible composition material, usually some form of elastomeric-like material.

My improved pad is indicated generally by the numeral 12 and is attached to the heel portion of the shoe sole.

As stated, the pad 12 preferably is formed of some elastomeric-like material such for instance as high density polyurethane. Also, in order to be as unobtrusive as possible and yet to provide an appreciable resistance to wear, I preferably cause the material to have a durometer of about 70 to about 95 on the Shore A scale.

As shown in the detail views, each pad 12 is generally triangular or tear drop in shape. Hereafter, I will use the expression "triangular" to include shapes both triangular and tear drop. Thus, the body may be described when viewed in plan as having a side 13, a base 14 and an hypotenuse 16. As shown in FIGS. 4, 5 and 6, it will be seen that the pad is thicker along the base 14 and side 13 than it is along the hypotenuse side. In fact, the wear surface 17 of the pad tapers in all directions from the side 13 and base 14 toward the hypotenuse 16 so that the hypotenuse 16 itself becomes a feather edge.

It will be understood that the surface 18 of the pad is generally flat so that it may be secured as by gluing or otherwise fastening to the sole 11 of the shoe.

To compensate for wear in the ball area of the shoe, I prefer to use a pad 15 formed of the same material as pad 12, but generally oval shaped and tapering from the center outwardly.

Figure 1:
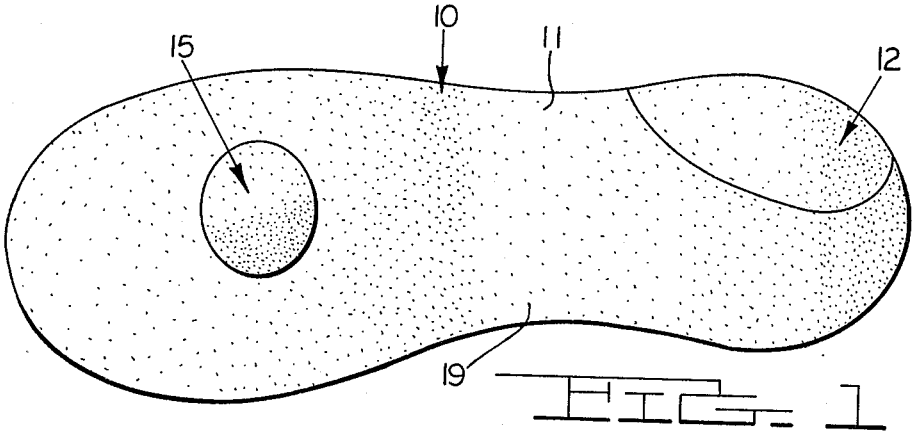
FIG. 1 is a plan view of an athletic shoe showing my improved pad in place on the heel portion of the sole of the shoe.
Figure 2:
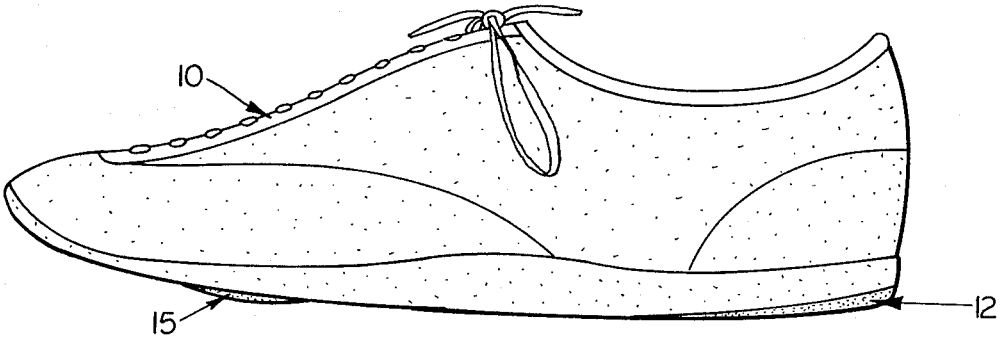
FIG. 2 is a side elevational view of the shoe shown in FIG. 1.

From the foregoing it will be seen that through the use of my improved pad one may selectively reinforce those particular portions of the sole of athletic shoes which wear the most, taking into account the individual's use of the same. By way of example, and as shown, one of the pads may be applied to the heel portion with the side 13 immediately adjacent the periphery of the sole. Generally, it will be found that for the average person the place of greatest wear is a portion of the heel opposite the instep 19 of the shoe. On the ball of the foot for the average person it will be found that the point of greatest wear is forward of the arch but behind the second toe as shown in FIG. 1. The pad 12 is placed with the thick edge 13 adjacent the edge of the sole, and with the thick base 14 of the generally triangular shape located rearwardly.

My improved reinforcing pad may be attached to the shoe by any suitable means, such as an adhesive.

In actual practice I have found that my improved reinforcing pads greatly prolong the life of running shoes. In view of the high cost of these shoes and the rapidity with which they wear in localized areas, my invention solves a problem of long standing and which is economically important to athletes. It will also be noted that I may supply my improved reinforcing pad with the feathered hypotenuse 16 so that it may be affixed to the side or sides of the sole of the shoe and then trimmed along the edge, if desired, thereby to make it conform precisely to the contour of the sole of the shoe.

While I have shown my invention in but one form, it will be obvious to those skilled in the art that it is not so limited, but is susceptible of various changes and modifications without departing from the spirit thereof.

What I claim is:

1. In a reinforcing pad for athletic shoes, an elastomeric-like body formed of material having generally the physical properties of high density polyurethane, said material having a durometer of from about 70 to 95 on the Shore A scale, said body being generally triangular shaped in plane view with the base and one leg thereof being the major thickness portion of the body, said body tapering from the base and side to substantially feather edge along the hypotenuse of the body, one side of the pad being generally flat, said pad being adapted for securement to the sole of a shoe in high-wear areas thereof with the flat side secured to the sole, the hypotenuse of the triangle extending generally fore and aft of the sole and with the thicker side of the body adjacent an edge of the sole.

* * * * *